United States Patent [19]

Chitouras

[11] 4,308,296

[45] Dec. 29, 1981

[54] METHOD OF CURING PARTICLE-COATED SUBSTRATES

[76] Inventor: Costa G. Chitouras, 10 Packard Ave., Somerville, Mass. 02144

[21] Appl. No.: 110,777

[22] Filed: Jan. 9, 1980

Related U.S. Application Data

[63] Continuation of Ser. No. 744,941, Nov. 24, 1976, abandoned, which is a continuation of Ser. No. 479,754, Jun. 17, 1974, abandoned.

[51] Int. Cl.[3] ..... B05D 3/06

[52] U.S. Cl. ..... 427/44; 427/26; 427/27; 427/206

[58] Field of Search ..... 427/44, 206, 200, 25, 427/26; 156/272

[56] References Cited

U.S. PATENT DOCUMENTS 3,903,331 9/1975 Klein ..... 427/44

4,100,311 7/1978 Nablo et al. ..... 427/44

*Primary Examiner*—John H. Newsome

*Attorney, Agent, or Firm*—Kenway & Jenney

[57] ABSTRACT

A method of curing the uncured adhesive on which elongated particles of material have been deposited in a relatively thick deposit or layer, (such as a flocked layer), the adhesive being on a substrate, which comprises subjecting the material to an electron beam directed toward the surface having the deposit, from apparatus for producing an electron beam of relatively low energy. The process is particularly adaptable to the curing of adhesives when used on heat-sensitive substrates, and/or where the particles may also be heat-sensitive, whose heat sensitivity would otherwise inherently limit the degree and speed of thermal curing that might be employed in order to cure the adhesive which holds the elongated particles to the substrate.

8 Claims, 2 Drawing Figures

METHOD OF CURING PARTICLE-COATED SUBSTRATES

This is a continuation of application Ser. No. 744,941, filed Nov. 24, 1976 which is a continuation of Ser. No. 479,754, filed June 17, 1974 and both now abandoned.

BACKGROUND OF THE INVENTION

Throughout this application, for convenience the invention is for the most part described as being used to cure the adhesive of flocked material. However, the invention is equally applicable to other elongated particles, such as those used in sandpaper. In the well established methods of making flocked material and also materials such as sandpaper, in which elongated particles are deposited on a substrate and secured thereto by an adhesive, the latter is first coated with the adhesive. Thereafter, by mechanical or electrostatic means the flock fibers are deposited on the substrate, each fiber standing on end thereon, the ends of the fibers being embedded in the uncured adhesive. As a result, the flock fibers or particles are attached only temporarily (prior to the setting of the adhesive) to the substrate, and the particular adhesive used must be then cured or set. The curing operation is commonly done in large heated ovens in which the substrate with its flocking is looped back and forth until it finally emerges at the exit end with the adhesive in a cured or polymerized condition.

Such treatments are relatively inefficient, are slow, and require large amounts of energy. As an example of the latter, a typical curing oven may be as much as 30 to 90 feet long, and typically will use six million BTU's of heat per hour during the passage of the material therethrough, due to the high water content where water-based adhesives are used. Where solvent-type adhesives are used, problems of pollution, flammability etc. arise. (This invention makes possible the use of monomers as adhesives which are polymerized by electron beam radiation.)

For tactile substrates, the temperature within the curing oven in which the material is treated varies between 240° F. and 325° F., but the temperature for thermoplastic substrates such as vinyl and styrene are generally half of the above temperatures.

Temperatures greater than 175° may result in distortion, wrinkling, or have other deleterious effects on heat-sensitive materials being treated. As a result, for such heat-sensitive materials, the curing operation is slow and limits production. If, for example, a vinyl substrate of the order of a few thousandths of an inch in thickness is flocked by conventional methods and then subjected to the heat of a curing oven, the vinyl substrate tends to wrinkle during the curing of the adhesive. The resultant material is generally not suitable for sale, and consequently it has been held to be unfeasible to flock such materials.

In respect to the time of curing, the normal traversal of flock material through an oven may take as long as 20 minutes or longer, due to the low temperatures used. The latter figure is only by way of illustrative example.

In addition, if a defect in the cured flocked material is detected, it oftentimes is only after it emerges from the exit of the oven. Since it is not known how far back in the curing oven the defect occurs, several hundred feet of flocked material are generally wasted before the process can be properly continued.

Still another problem with the conventional adhesive-curing operations is the production down-time necessary for cleaning the ovens.

SUMMARY OF THE INVENTION

Accordingly, it is the basic purpose of this invention to provide a method of curing the adhesive on the substrate on which elongated fibers or particles have been deposited, in a simple, rapid manner which uses low energy, is clean, requires minimum down-time, and permits the manufacture of flocked material in which the thickness of a heat-sensitive substrate may be as little as 0.002–0.004 inches (but with particle heights one to three orders of magnitude greater), in all cases the adhesive being cured in a matter of milli-seconds by means of electron beam radiation.

One object of the present invention, accordingly, is to provide a novel electron-beam curing process that solves many prior art problems in the flocking industry and enables high speed adhesive curing without any deleterious effect upon substrates and upon the flock material itself.

A further object is to provide a new and improved flock and related curing process of more general applicability as well.

Further, from one of its broad aspects, the invention embraces a process for curing flock material adhesively secured to a substrate that comprises: applying an electron-beam curable adhesive layer to a substrate, flocking fiber material upon the adhesive layer, passing the assembly of substrate and adhesively secured flocking material past a predetermined region, directing electron beam energy (at said predetermined region) upon the flocking material and upon the adhesive layer, and thus curing the adhesive layer.

Other objects, features and advantages will be in part apparent and in part pointed out hereinafter.

The invention accordingly comprises the steps and sequence of steps, and features of operation which will be exemplified in the methods hereinafter described, and the scope of the application of which will be indicated in the following claims.

Figure 1:
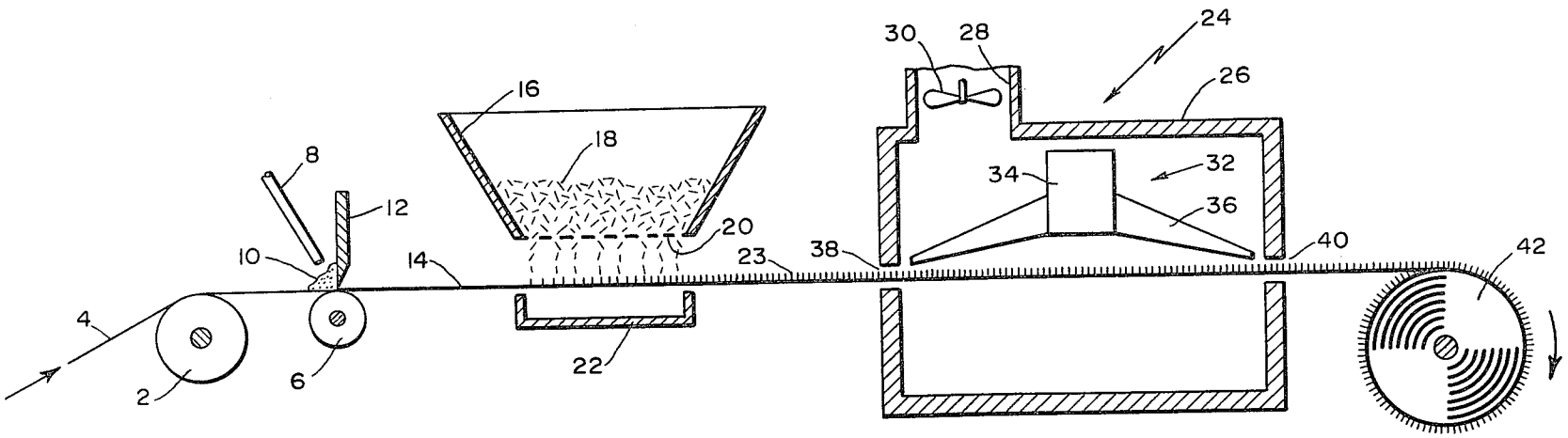
FIG. 1 shows schematically a single elevational view of a production line utilizing the above invention.

Throughout the drawing, dimensions of certain of the parts as shown in the drawing may have been modified and/or exaggerated for the purposes of clarity of illustration and understanding of the invention.

Referring to FIG. 1, a production line feed entrance roll upon which is trained a sheet of textile material, plastic or otherwise which is to be flocked, a roll over which the entrained material passes and providing a means for applying adhesive to the layer of material, an electrostatic flocking apparatus by means of which flock material is deposited in upright fashion on the adhesive-coated substrate, an electron beam radiation machine by means of which the adhesive used on the substrate is cured, and a take-up roll.

Entrance roll 2 is shown which may be of conventional type and over which the material 4 to be flocked is entrained. The material then passes over a roll 6, and on the substrate there is deposited by means of a conventional supply pipe or other means 8, an adhesive 10 of the kind which may be "cured" by means of an electron beam. A doctor blade 12 is used with roll 6 in conventional manner in order to govern the thickness of the adhesive 14 applied to the substrate 4. (In the drawing, the presence of the adhesive 14 is illustrated by the thicker line which emerges from the roll 6 and doctor blade 12.)

The thus-coated material then passes through a conventional flocking machine schematically illustrated as having a container 16 which is loaded with a flock material 18 of the material to be deposited on the substrate. An energizing screen 20 (in the case of electrostatic flocking) is provided, of conventional nature, at the lower end of the container 16, and below the layer of substrate is the collecting member 22. In typical fashion, although not illustrated, a high voltage either alternating or d.c. is applied between the container 16 and the bottom trough or collector 22 in oder to orient and/or propel the fiber flock material onto the substrate 4.

As a result of the voltage, as is well known in the flocking industry, the flock 18 is deposited on the adhesive-coated substrate 16 as the generally upright elements 23 have their lower ends embedded in the as yet uncured adhesive. All that now remains is to cure the adhesive in order to securely anchor the flocking elements to the substrate.

It is here that the problem arises since the curing of flocked fibers and the like adhered to heat-sensitive substrates has heretofore been effected at relatively low speeds, say of the order of 30 to 60 feet per minute, more or less, primarily because of the prior art limitations upon the time rate and amount of thermal energy that may be applied without deleteriously affecting the heat sensitive substrate 4 or the flock material 18, 23 itself. (This compares with the speed of curing of this invention which has been, experimentally, determined to be possible at rates exceeding 200 feet per minute.)

In the normal process, as described earlier, after the material is flocked with the adhesive still uncured as it emerges from the flocking apparatus, it then traverses a curing oven where the temperature is maintained in general from 150° to 325° F. As stated, the material traverses the typical curing oven which is so constructed that the material layer therewithin loops back and forth before eventually emerging from the chamber to take-up roll. Because of the low temperature in the heating chamber, and the lack of high thermal conductivity in the generally used substrate and the organic adhesives used as well as the flocking material, the transmission of heat into the adhesive is very slow. As a result, the material emerges from the exit end of the heating oven in the order of about 20 yards of flocked material per minute.

As contrasted to the prior art methods, the present invention contemplates the almost instantaneous curing of the adhesive by means of an electron beam. Throughout the industry, it has been considered that the curing of the adhesive under a flocked layer by electron-beam radiation of low energy levels is not possible. It is known that thin layer coatings can be cured by an electron beam. The thickness of such surface coating usually do not exceed 0.005 inches. For this reason, it has been believed by the industry that it is impossible to use electron-beam radiation to cure the adhesive of flocked material by low energy electron beam radiation, because of the height (and thus vertical "thickness") of the flock material which would prevent the electrons from reaching the adhesive.

Figure 2:
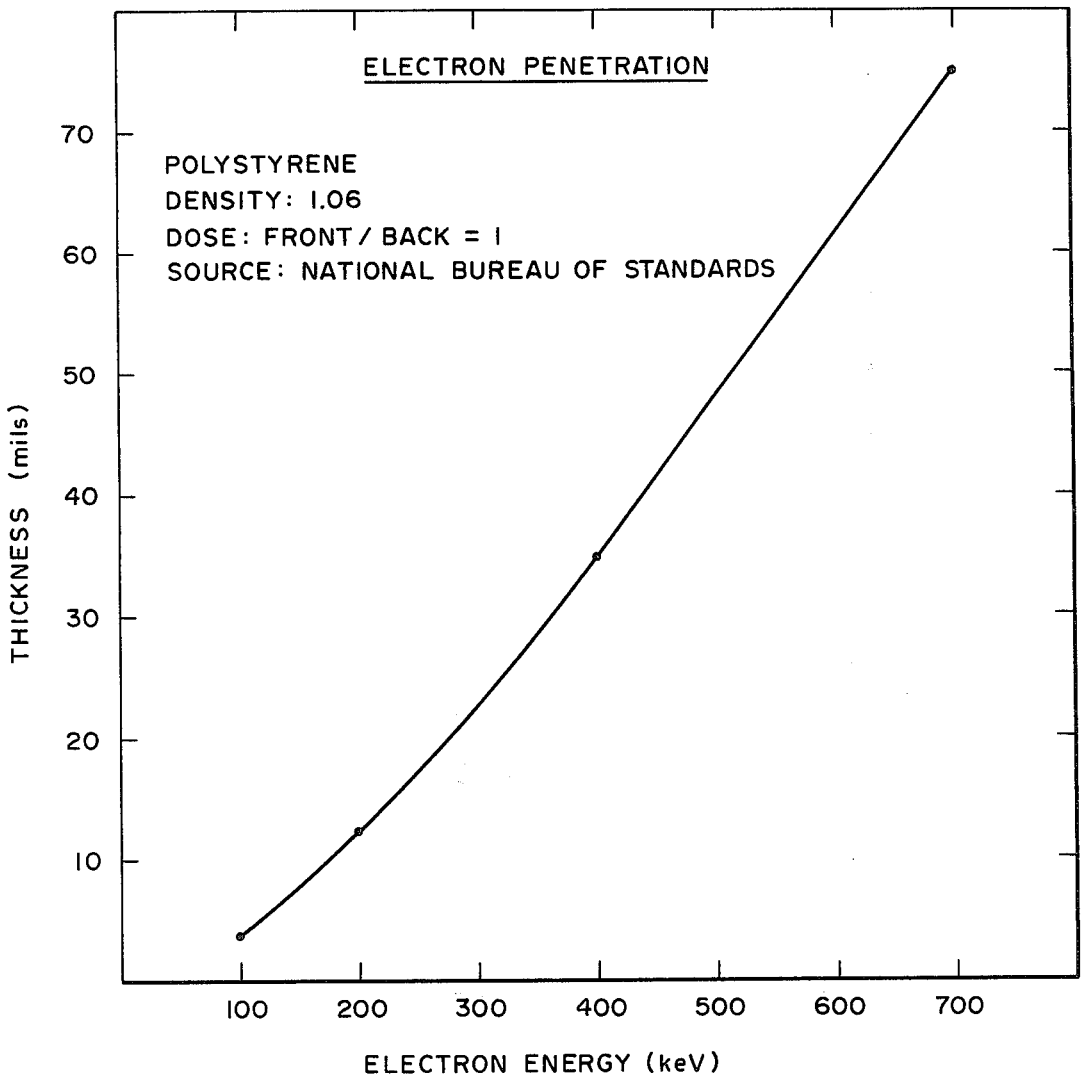
FIG. 2 is a graph showing the commonly accepted relationship between the electron penetration in a material as a function of electron voltage, the material having a density of 1.06 (polystyrene).

Referring to FIG. 2, and using the curve as a basis for computing the electron-beam voltage requirement to penetrate a given depth of plastic such as polystyrene having a density of 1.06, it would appear to the prior art that for a flock (particle) height of 0.050 inches, the electron-beam voltage required (if the fibers are of the above material) is greater than 500 Kev. It is this teaching, well-known in the art, that has led the flocking industry away from considering the use of electron beam radiation as a solution for the many problems in the flocking industry. The reason a 500 Kev machine was not used, is because of the high cost, the deleterious effect of such energies on the flock and substrate, and the large masses of shielding needed for machines of such energy dissipation. Had one examined, in the light of the curve, the possibility of using the low energy electron beam machine for curing the resin of a flocked material, he would have immediately dismissed the idea as being impractical and impossible. Considering that the length of the flock fibers can be up to, as an example, 0.090 inches, the effective "thickness", according to the prior art, would then be 0.090 inches, and impenetrable to electron beam radiation.

In accordance with the present invention, however, after the substrate with the flocked material 23 thereon leaves the flocking machine 16–22, it then traverses an electron-beam radiation apparatus indicated generally by numeral 24. The apparatus is enclosed in a shielding enclosure 26. The electron beam machine is conventional and may, for example, be a machine Type CB 150 manufactured by Energy Sciences Inc. of Burlington, Mass. Such a machine can be adjusted to produce an electron beam energy of 15 Kev±30% and an electron dose of the order of two Megarads±30%, as an example, or a higher dosage if desired. The actual dosage required by the material to be cured is a function of the adhesive used; the actual dosage received is determined by the time of application of the electron-beam and the beam intensity. At the above adjustments, it has been observed from testing, that if the flocked material passes the electron-beam at a speed of the order of 150–200 feet per minute, the flocking adhesive will be cured without affecting the substrate. As an example, such an electron beam machine is described in U.S. Pat. Nos. 3,769,600 and 3,745,396 and is easily designed to direct its energy at a predetermined region upon elongated particulate fibrous material. As a result, it has been found unexpectedly and contrary to the teaching of the prior art, that the electron beam radiation will penetrate the flocking material (at the relatively low Kev potentials described above) and impinge upon an electron-beam curable adhesive in which the flock is embedded on a substrate. Within the parameters given above, rapid and highly effective practically instantaneous curing of the adhesive binding the flocking material to the substrate can be effected. The above results were obtained with electron window-to-article spacing of the order of about one inch±20%.

The electron-beam apparatus indicated generally by numeral 32 comprises an electron beam producing gun 34 and shields 36 available on the market. The outer shielding chamber 26 has an outlet duct 28 with a fan 30 mounted therein. The purpose of the fan is to dissipate from the shielding member 26 any ozone created by the electron beam. The radiation proof container 26 is provided with an entrance slit 38 and the exit slit 40 through which the flocked material 14, 23 passes below the electron beam of gun 32. After the material is bombarded, and the curing of the adhesive has taken place within the shielded housing 26, the flocked material with the adhesive already cured is taken up by the take-up roll 42.

As a first example, a rayon challis substrate was coated with a 0.004 inch thickness of Dow 7331.01 adhesive, and nylon flock fibers of 3 denier, and approximately 0.030 inch length were electrostatically flocked in conventional manner thereon. The adhesive of this combination was cured by Energy Sciences Inc. Type No. CB-150 machine. The electron energy of the Type No. CB-150 was adjusted so that the dosage was approximately two Megarads with an electron voltage of approximately 170 Kev.

As a second example, a rubber automobile window channel material was brush coated with approximately 0.004 inches of Hauthaway XJ2-408-E adhesive (supplied by C. L. Hauthaway & Sons Corp., 638 Summer St., Lynn, Mass.), upon which polyester fibers approximately 0.030 inches long and having a denier of 3 were electrostatically flocked. Upon passage of the flocked material through the radiation from the above electron-beam generator, the dosage being 4 Megarads and electron energy being 170 Kev, the adhesive was cured. The CB-150 machine was used.

As a third example, a vinyl substrate was knife-coated with approximately 0.004 inches of Hauthaway XJ3-149-B adhesive, upon which rayon fibers approximately 0.050 inches long and having a denier of 5.5 were electrostatically flocked. Upon passage of the flocked material through the radiation from the above electron-beam generator, the dosage being 8 Megarads and electron energy being approximately 170 Kev, the adhesive was cured. Again, the CB-150 machine was used.

After the flock material is cured and leaves the flocking and curing machine, it then traverses to the take-up roll 42 and other apparatus whose purpose is to accomplish certain operations which are not a part of this invention. Such operations could be, for example, cutting the material to a given length, stamping flocked configured designs from the material, etc.

As a further example, successful similar curing of the adhesive has been effected, with the same apparatus and adjustments on temperature-sensitive styrene substrates. Wood and paper substrates have also been employed to carry the electron-beam curable adhesive-flock coating in which the particles have been placed. Other types of electron-beam curable adhesives, such as acrylic epoxies, styrene, vinyl chloride, unsaturated polyesters, and other types of flocking materials such as rayon and polyesters, all with dose and energy level adjustments within the before-stated ranges have been used successfully. The adhesives can lie within the range of 0.001–0.008 inches, within the ranges stated above. The reason for the ability of curing the adhesives beneath a relatively thick layer of flocked or otherwise deposited upstanding particles, by means of electron-beams is not completely understood at this time. However, it is thought to be a function or combination of direct electron radiation and radiation resulting from electron scattering. As a result of scattering, the direction of scattered electrons is at such an angle to the axis of each particle that the adhesive adjacent and very possible beneath each particle is cured.

The advantages of the invention also include, in addition, the fact that since at the time the flocked material with unset resins enters the prior art ovens, extreme care in handling the material during its passage through the oven and up to the time that the adhesive is cured is needed, in order not to disturb the arrangement of the flock in the material and thus introduce discontinuities which would result in the rejection of the flocked material.

A further advantage of practical and commercial significance is that pointed out briefly above, namely: If, for example, upon emergence from a prior art curing oven, a defect is found, then it is necessary to stop the flow through the oven, and then examine all of the material found within the oven which may be several hundred feet, in order to determine just where the defect starts and what is its cause. As a result of this, it may be found that since the defect is observed upon the exit of the material from the curing oven, there may be several hundred feet of material defective which must be wasted. On the contrary, in the present process, once the material emerges from the adhesive curing apparatus 24, the material can be immediately inspected, and if a defect is found the only material that needs to be wasted is the material extending from the inlet side of the adhesive curing apparatus to the exit side thereof, a length of approximately 10 feet. The result of this is a very practical economy in that far less waste material will need be removed from the production line. Also, down-time will be greatly lessened.

As indicated above, the main advantages are (a) savings in energy required for curing, since the actual energy required by the adhesive curing apparatus 24 is approximately 1%–10% of the energy required for the typical oven curing apparatus; and (b) the ability to use 100% solids, non-polluting, adhesives.

Briefly mentioned above is another advantage of the invention: There has been needed for a long time a way of economically and quickly making a flocked material in which the substrate is a very thin vinyl or other thermosetting material of the order of, for example, 0.004 inches or less in thickness. It has been found by practical experience that if such a material is coated with adhesive, flocked by conventional methods, and then cured in a typical curing oven, the vinyl material, even though the oven temperature is low, emerges from the exit end in a rather wrinkled or distorted configuration. Of course, in most instances such wrinkled material is not suitable for resale. On the contrary, it is possible by this invention, to flock such vinyl material and then cure the adhesive by means of the aforesaid described process without wrinkling the substrate at all.

As to the flocking apparatus 16–22 itself, a machine such as the Micro-Stat No. 238 Flocking Machine manufactured by Indev Inc., Machinery and Equipment Division of 1 Mochassuck St., Pawtucket, R.I. will be found suitable.

In the above, the speed of production through the apparatus depends on the electron-beam energy available as measured in terms of available electron beam current from a particular machine; and the requirements of the particular adhesive. There are a large number of adhesives which are curable by means of electron beam radiation; and these adhesives, in view of their various compositions, require varying dosages for curing, these dosages being measured in Megarads. In view of the number of adhesives available, it is not possible in this application to list them and the dosages required for a particular adhesive. However, such dosages for a given material can be found by the commercial operator of the apparatus without the need of any inventive effort.

It has been estimated that better than 150 million yards of flocked material are made in the United States per year. By the use of this invention, appreciable and commerically significant reductions in the cost of production of such material will be effectuated. These savings are due, as explained above, to (a) the low energy levels required in using electron-beam radiation to cure the adhesive resins, (b) the greatly increased production rate of curing the adhesive (as compared to present day rates of curing), and (c) the reduction of waste material when a defect occurs.

In view of the above it will be seen that the several objects of the invention are achieved and other advantageous results attained.

It is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

As many changes could be made in the above constructions without departing from the scope of the invention, it is intended that all matter contained in the above description or shown in the accompanying drawings, shall be interpreted as illustrative and not in a limiting sense, and it is also intended that the appended claims shall cover all such equivalent variations as come within the true spirit and scope of the invention.

Having described the invention, what is claimed is:

1. A method of making a flocked material comprising the following steps.

(1) providing a substrate having an adhesive of the type which may be cured by an electron beam on the substrate forming an electron beam curable adhesive layer;

(2) depositing elongated particles of flock material to form a layer of flock sufficiently thick so that the elongated particles of flock block the direct path of electrons travelling toward the adhesive layer; and, (3) curing the adhesive by directing a beam of electrons through the layer of flock toward the adhesive layer with an electron energy less than would be required for a nonparticulate layer of the same flock material and of a thickness equal to the actual thickness of flock material in the electrons path, but at least equal to the energy level necessary to cure the adhesive in the adhesive layer without said particles of flock material.

2. The method as set forth in claim 1 in which the adhesive is cured in step (3) by directing a beam of electrons having energy in the order of 150 Kev±30%.

3. The method as set forth in claim 1 in which the length of the elongated particles of flock deposited in step (2) are in the order of 2–50 times that of the adhesive layer thickness.

4. The method as set forth in claim 1 in which the length of the elongated particles of flock deposited in step (2) range from 0.002 inches to 0.25 inches and the denier thereof ranges from 0.1 to 100.

5. A method of making a flocked material comprising the following steps:

(1) providing a substrate;

(2) applying an adhesive of the type which may be cured by an electron beam on the substrate forming an electron beam curable adhesive layer;

(3) depositing elongaged particles of flock material to form a layer of flock sufficiently thick so that the elongated particles of flock block the direct paths of electrons travelling toward the adhesive layer; and (4) curing the adhesive by directing a beam of electrons through the layer of flock toward the adhesive layer with an electron energy less than would be required for a nonparticulate layer of the same flock material and of a thickness equal to the actual thickness of flock material in the electrons path, but at least equal to the energy level necessary to cure the adhesive in the adhesive layer without said particles of flock material.

6. The method as set forth in claim 5 in which the adhesive is cured in step (4) by directing a beam of electrons having energy in the order of 150 Kev±30%.

7. The method as set forth in claim 5 in which the length of the elongated particles of flock deposited in step (3) are in the order of 2–50 times that of the adhesive layer thickness.

8. The method as set forth in claim 5 in which the length of the elongated particles of flock deposited in step (3) range from 0.002 inches to 0.25 inches and the denier thereof ranges from 0.1 to 100.

* * * * *